US010337359B2

(12) United States Patent
McCutcheon et al.

(10) Patent No.: US 10,337,359 B2
(45) Date of Patent: Jul. 2, 2019

(54) ROCKER ARM SPRING RETAINER

(71) Applicant: EATON CORPORATION, Cleveland, OH (US)

(72) Inventors: Steven E McCutcheon, Fort Wayne, IN (US); Eric J. Yankovic, Augusta, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/567,271

(22) PCT Filed: Apr. 15, 2016

(86) PCT No.: PCT/US2016/027994

§ 371 (c)(1),
(2) Date: Oct. 17, 2017

(87) PCT Pub. No.: WO2016/168770

PCT Pub. Date: Oct. 20, 2016

(65) Prior Publication Data

US 2018/0291772 A1 Oct. 11, 2018

Related U.S. Application Data

(60) Provisional application No. 62/149,504, filed on Apr. 17, 2015, provisional application No. 62/153,131, filed on Apr. 27, 2015.

(51) Int. Cl.
*F01L 1/18* (2006.01)
*F01L 13/00* (2006.01)

(52) U.S. Cl.
CPC ..... *F01L 1/185* (2013.01); *F01L 13/0005* (2013.01); *F01L 2001/186* (2013.01); *F01L 2001/187* (2013.01); *F01L 2105/00* (2013.01)

(58) Field of Classification Search
CPC ... F01L 1/185; F01L 13/005; F01L 2001/186; F01L 2001/187; F01L 2105/00
(Continued)

(56) References Cited

U.S. PATENT DOCUMENTS 6,532,920 B1 3/2003 Sweetnam et al.
7,673,605 B2 * 3/2010 Hiramatsu ..... B21K 1/205 123/90.39

(Continued)

FOREIGN PATENT DOCUMENTS

DE 10344406 A1 4/2005
EP 0101222 A2 8/1982

(Continued)

OTHER PUBLICATIONS

International Search Report and Written Opinion for PCT/US2016/027994 dated Jul. 26, 2016, pp. 1-10.

(Continued)

*Primary Examiner* — Ching Chang
(74) *Attorney, Agent, or Firm* — Mei & Mark, LLP

(57) ABSTRACT

A retainer comprises an inner tubular portion fitted to a mounting body. The inner tubular portion comprises an inner circular edge having a radius R3. An annular retaining surface is connected to the tubular portion. The annular retaining surface comprises an area bounded by an outer edge and the inner circular edge. The outer edge being bounded by an arc AD comprising a first radius R1, a sector CB comprising a second radius R2, where R1>R2, a first chord DC connecting the arc AD to the sector CB, and a second chord BA connecting the arc AD to the sector CB. A rocker arm assembly comprises a rocker arm body configured to actuate a valve in a valve train. The retaining surface
(Continued)

abuts a spring coil to retain the coil against the rocker arm body, but the retaining surface does not abut a first arm of the spring.

19 Claims, 4 Drawing Sheets

(58) Field of Classification Search
USPC ..... 123/90.39, 90.65, 90.66, 90.67
See application file for complete search history.

(56) References Cited

U.S. PATENT DOCUMENTS

| | | | |
|---|---|---|---|
| 8,215,275 | B2 | 7/2012 | Church |
| 8,635,980 | B2 | 1/2014 | Church |
| 8,726,862 | B2 | 5/2014 | Zurface et al. |
| 8,752,513 | B2 | 6/2014 | Zurface et al. |
| 2007/0193543 | A1 | 8/2007 | Best |
| 2008/0245330 | A1 | 10/2008 | Deierlein et al. |
| 2010/0300389 | A1 | 12/2010 | Manther et al. |
| 2011/0226208 | A1 | 9/2011 | Zurface |
| 2013/0233265 | A1 | 9/2013 | Zurface et al. |
| 2013/0255612 | A1 | 10/2013 | Zurface et al. |
| 2013/0306013 | A1 | 11/2013 | Zurface et al. |
| 2013/0312506 | A1 | 11/2013 | Nielsen et al. |
| 2013/0312681 | A1 | 11/2013 | Schultheis et al. |
| 2013/0312686 | A1 | 11/2013 | Zurface et al. |
| 2013/0312687 | A1 | 11/2013 | Zurface et al. |
| 2013/0312688 | A1 | 11/2013 | VanDeusen |
| 2013/0312689 | A1 | 11/2013 | Zurface et al. |
| 2014/0290608 | A1 | 10/2014 | Radulescu |
| 2014/0305765 | A1 | 10/2014 | Serkh |

FOREIGN PATENT DOCUMENTS

| | | | |
|---|---|---|---|
| EP | 2418359 | A1 | 2/2012 |
| JP | 59046346 | | 3/1984 |
| JP | 2009509081 | A | 3/2009 |
| JP | 2013522542 | A | 6/2013 |
| KR | 10-2008-0026841 | A | 3/2008 |
| WO | WO-2011116331 | A2 | 9/2011 |

OTHER PUBLICATIONS

Radulescu et al., "Switching Response Optimization for Cylinder Deactivation with Type II Passenger Car Applications," SAE International, Technical Paper 2014-01-1704, Published Apr. 1, 2014, pp. 1-16.

* cited by examiner

ROCKER ARM SPRING RETAINER

This is a § 371 National Stage entry of PCT/US2016/027994 filed Apr. 15, 2016, which claims the benefit of priority of U.S. provisional application No. 62/149,504, filed Apr. 17, 2015 and U.S. provisional application No. 62/153,131, filed Apr. 27, 2015, all of which are incorporated herein by reference.

FIELD

This application provides a retention of a rocker arm spring.

BACKGROUND

A valve train rocker arm is subject to rigorous use, actuating many thousands or millions of time over the lifetime of an engine's operation. The rocker arm "rocks" for valve lift and lowering. Over time, repetitive stress can lead to rocker arm failure.

SUMMARY

The methods and devices disclosed herein overcome the above disadvantages and improves the art by way of a retainer and a rocker arm with reduced stress points.

A retainer comprises an inner tubular portion comprising an inner circular edge having a radius R3. An annular retaining surface is connected to the tubular portion. The annular retaining surface comprises an area bounded by an outer edge and the inner circular edge. The outer edge is bounded by an arc AD comprising a first radius R1, a sector CB comprising a second radius R2, where R1>R2, a first chord DC connecting the arc AD to the sector CB, and a second chord BA connecting the arc AD to the sector CB.

A rocker arm assembly comprises a rocker arm body configured to actuate a valve in a valve train. The rocker arm body comprises a ledge, a mounting body, and an extension. A spring comprises a coil wrapped around the mounting body. A first arm extends from the coil and abuts the extension. A second arm extends from the coil and abuts the ledge. The spring is tensioned between the extension and the ledge. A retainer comprises an inner tubular portion fitted to the mounting body. The inner tubular portion comprises an inner circular edge having a radius R3. An annular retaining surface is connected to the tubular portion. The annular retaining surface comprises an area bounded by an outer edge and the inner circular edge. The outer edge being bounded by an arc AD comprising a first radius R1, a sector CB comprising a second radius R2, where R1>R2, a first chord DC connecting the arc AD to the sector CB, and a second chord BA connecting the arc AD to the sector CB. The retaining surface abuts the coil to retain the coil against the rocker arm body, but the retaining surface does not abut the first arm.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Reference will now be made in detail to the examples which are illustrated in the accompanying drawings. Wherever possible, the same reference numbers will be used throughout the drawings to refer to the same or like parts. Directional references such as "front" and "rear" are for ease of reference.

Figure 1A:
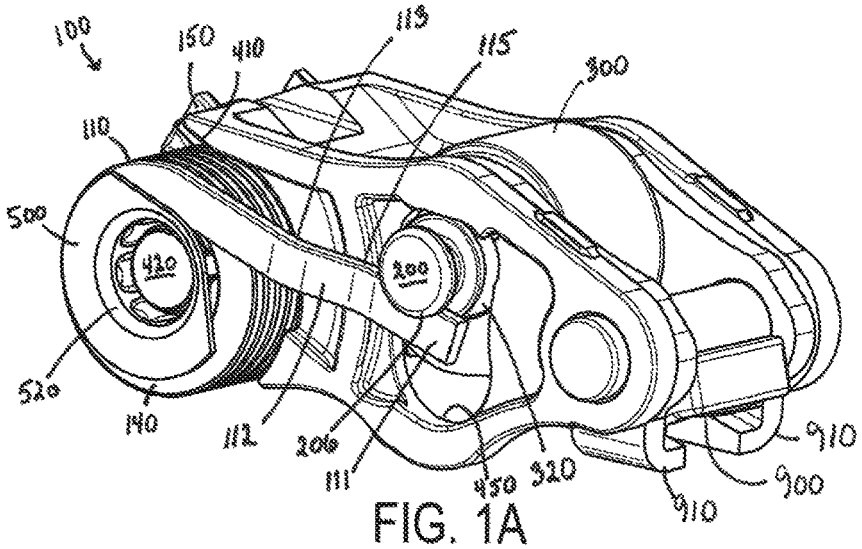
FIGS. 1A-1C are views of alternative rocker arm assemblies comprising alternative springs.
Figure 1B:
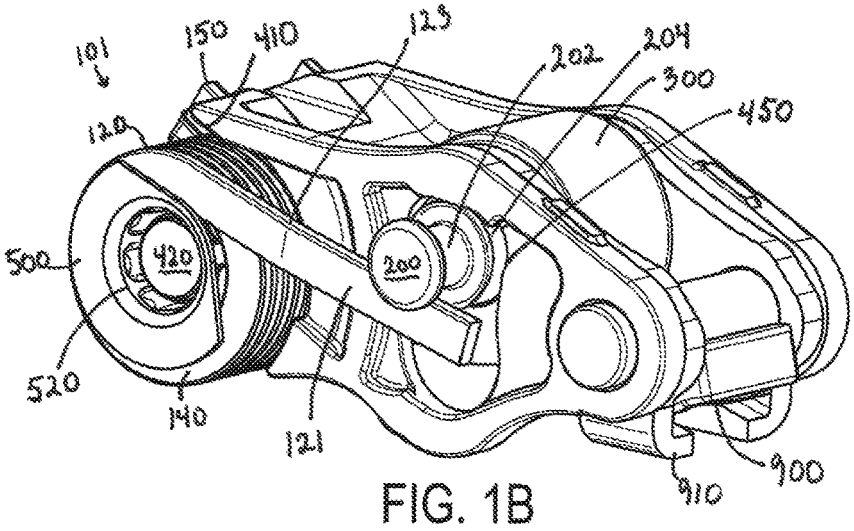
Figure 1C:
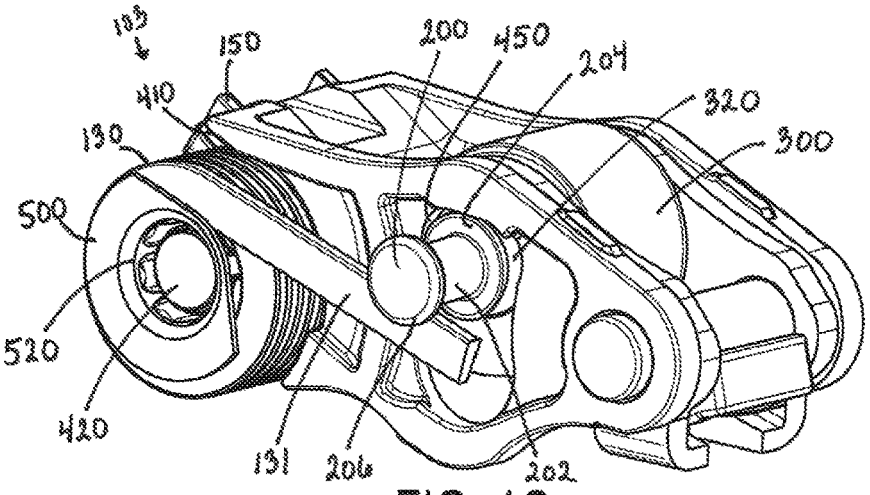

FIGS. 1A-1C are views of alternative rocker arm assemblies 100, 101, 103 comprising alternative springs 110, 120, 130. The springs are coiled. An arm 111, 121, 131 extends out from the coil 140 and is positioned beneath an extension 200. The extension 200 can have a "dog bone" shape, so that the arm 111, 121, 131 seats in a low diameter area 202 between high diameter ends 204, 206 of the extension 200. The extension 200 can connect to, or be integrally formed with, the bearing axle 320. A second arm 150 extends from a second end of the coil 140, and the second arm 150 is braced against a ledge 410 in the rocker arm body 400. When a cam on the valve train pushes the bearing 300 down to actuate an associated valve, the spring 110, 120, 130 is biased to return the bearing 300 to its start position.

In FIG. 1A, a high bend 112 in spring 110 is shown. The number of windings in the coil 140 distances the arm 111 away from the rocker arm body 400. The arm 111 "jogs-over" to reduce how far it strays from the profile of the rocker arm body 400. By bringing the arm 111 closer to the rocker arm body 400, the extension 200 can be shorter, and project less from the rocker arm body 400 than in the alternatives of FIGS. 1B & 1C. The high bend 112 comprises a first angle bend 113 and a second angle bend 115 between the coil 140 and the extension 200. By bending the arm 111, the over-all profile of the rocker arm assembly 100 is smaller, and it desirable for tight engine compartment packaging that the area consumed by the rocker arm assembly 100 is small.

FIG. 1B shows a low bend 122 in spring arm 121. The arm 121 does not "jog-over" as much as arm 111. A single angle bend 123 is shown in arm 121 between the coil 140 and the extension 200. The extension 200 and arm 121 jut out from the rocker arm body 400 over a greater area than the arrangement of FIG. 1A, and the rocker arm assembly 101 profile is larger.

FIG. 1C shows no bend in spring arm 131. The arm 131 is essentially parallel to the coils 140, and the first arm 131 extends in a straight line from the coil to the extension 200. The extension 200 and arm 131 jut out from the rocker arm body 400 over a greater area than the arrangement of FIGS. 1A & 1B, and the rocker arm assembly 103 profile is larger.

Figure 2:
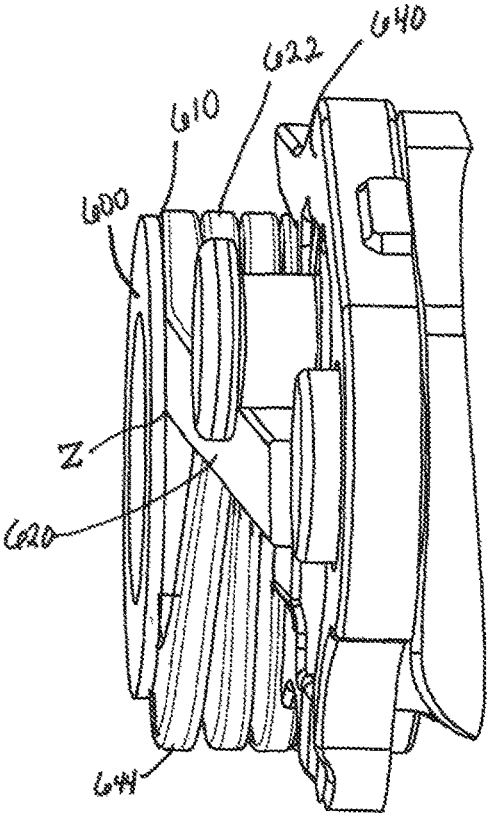
FIG. 2 is a view of a high stress rocker arm arrangement.
Figure 3:
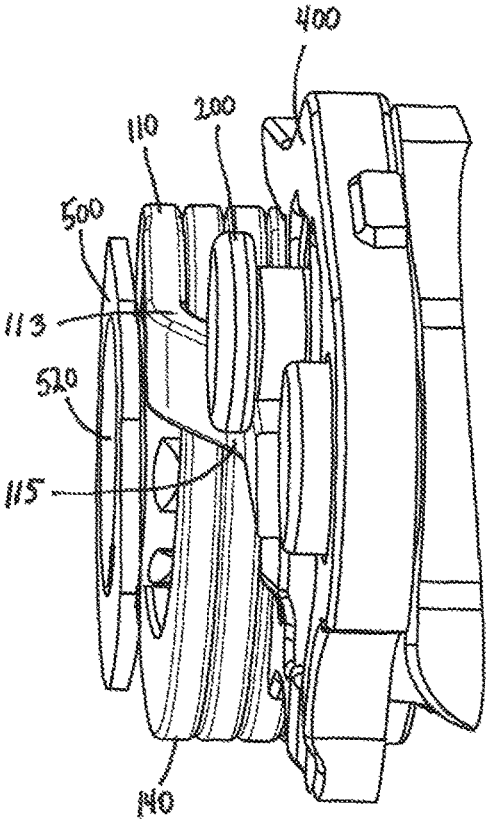
FIG. 3 is a view of a low stress rocker arm arrangement.

Comparing FIGS. 2 and 3, other effects of the retainer design on the high bend spring 110 versus low or no bend springs 120, 130 can be seen. When a traditional retainer 600 is used to secure a spring 622 against a rocker arm body 640, the retainer contacts the spring non-uniformly. The arm 620 strains against the retainer 600 because the retaining surface 610 is uniform about its annular circumference. The bent arm 620 can push in a localized point Z on the retaining surface 610. Over time, a micro-crack can grow and the retaining surface 610 can break, causing valve actuation failure. FIG. 2 also shows that the coils 644 of spring 622 fan apart. The fanned springs can rub, leading to wear-off of material, which is contamination in the engine compartment. The wear zones are also failure points. The retaining surface 610 abuts the coil 644 to prevent play, but the uniformity of the retaining surface 610 places uneven forces on the spring 622 and on the retaining surface 610.

It is desirable to secure the springs 110, 120, 130 with respect to the rocker arm body 400 without play towards and away from the rocker arm body 400. So, in FIG. 3, it is desired to have the retainer 500 contact the coil 140. But, the contact should minimize or eliminate fanning of the coil 140. Strategic reduction of the retaining surface 510 can provide good spring seating while reducing fanning, micro-fractures and cracking in the retaining surface 510, and rocker arm assembly failure. So, the retaining surface 510 abuts the coil 140 to retain the coil against the rocker arm body 400, but the retaining surface 510 does not abut the first arm 111, 121, or 131 so as to cause a localized point Z of pressure.

The retaining surface 510 of retainer 500 has crescents of space for eliminating pressure points between the retaining surface 510 and spring arms 111, 121, 131. The extent of the crescents is chosen to maximize retention of the spring coil, while minimize coil fanning and pressure points.

Figure 5:
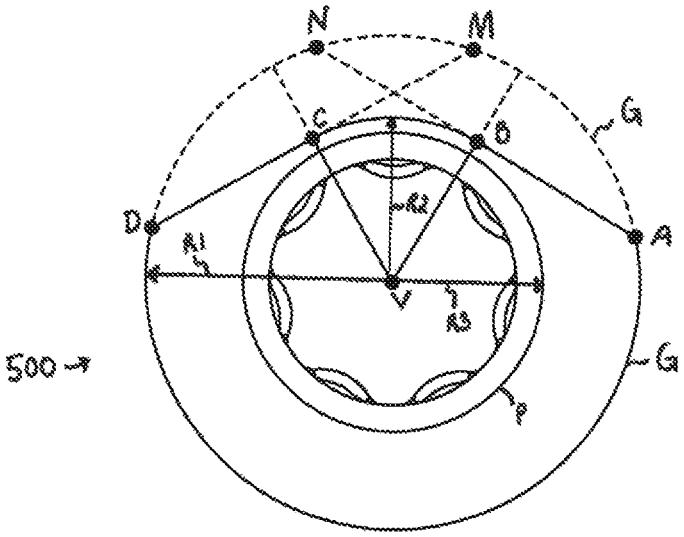
FIG. 5 is a front view of a retainer.

To describe the curve of the crescent retainer 500, it is helpful to consider the retaining surface 510 with respect to a geometric circle G, shown in broken and solid lines in FIG. 5. An inner portion 520 comprises a tubular portion 530 that can be patterned or corrugated for gripping a mounting body 420 on the rocker arm body 400. The tubular portion 530 can press fit to the mounting body 420. An outer edge 430 is concentric with the inner portion 520 along an arc AD. The outer edge 430 and the inner portion 520 form an annulus with respect to a center point V. A sector CB of the outer edge has a reduced radius R2 that is smaller than the radius R1 of the arc AD. The arc AD adjoins a first chord DC, and the segment DCM is omitted from the retaining surface 510. The opposite end of arc AD adjoins second chord AB, and the segment ABN is omitted from the retaining surface 510. First chord DC connects first end of arc AD to point C of the sector CB. Second chord BA connects point B of sector CB to second end of arc AB. The retaining surface 510 can be described as an annulus comprising an area bounded on an outer edge by an arc AD comprising a first radius R1, a sector CB comprising a second radius R2, where R1>R2, a first chord DC connecting the arc AD to the sector CB, and a second chord BA connecting the arc AD to the sector CB. The annular area of the retaining surface 510 is bounded on an inner edge by an inner circle P having a radius R3<R2<R1.

Figure 6:
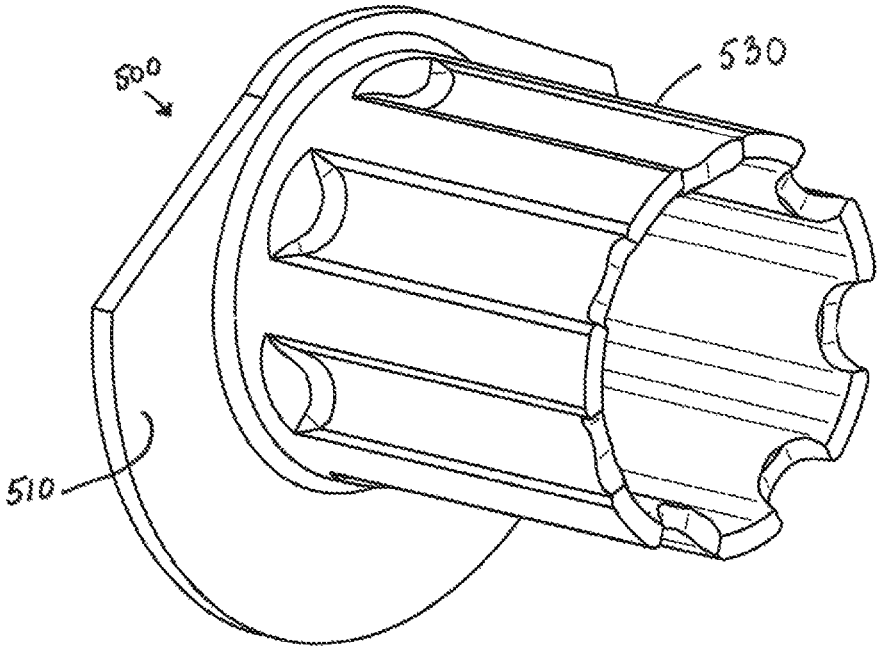
FIG. 6 is a rear view of the retainer of FIG. 5.

FIG. 6 shows the rear of the retainer 500. The inner tubular portion 520 is fitted to the mounting body. The inner tubular portion 520 can be corrugated or otherwise patterned for fitting to the mounting body. A press-fit can be used, though other fitting techniques, such as crimp fitting, can alternatively be used. The mounting body 420 can also be corrugated. It is possible to align the corrugations on the mounting body to lock against the corrugations on the inner tubular portion.

In use, the rocker arm body is used in conjunction with a cam rail. A spinning cam pushes on a bearing 300 mounted to a bearing axle 320. The bearing axle 320 can be integrally formed with the extension 200. The extension 200 passes through a slot 450 in the rocker arm body 400. The spring 110, 120, 130 biases the extension 200 against one end of the slot 450. Opposing forces from the cam rail selectively move the extension 200 towards the opposite end of the slot 450. The extension 200 is coupled to the bearing axle 320 to move with the bearing axle 320 when the cam presses on the bearing 300.

The force of the cam pressing on the bearing 300 opposes the spring force biased between the ledge 410 and the extension 200. The opposing force from the cam transfers to the spring 110, 120, 130, and impacts the coil 140 of the spring, pushing on it. The retainer 500 resists the forces transferred to the spring 110, 120, 130 without pushing on the first arm 111, 121, 131. The crescents of material removed from the retainer, and hence the outer edge of the annular retaining surface 510, are selected to balance retention function, security of fitment, and elimination of interference with the first arm 111. 121, 131.

Figure 4:
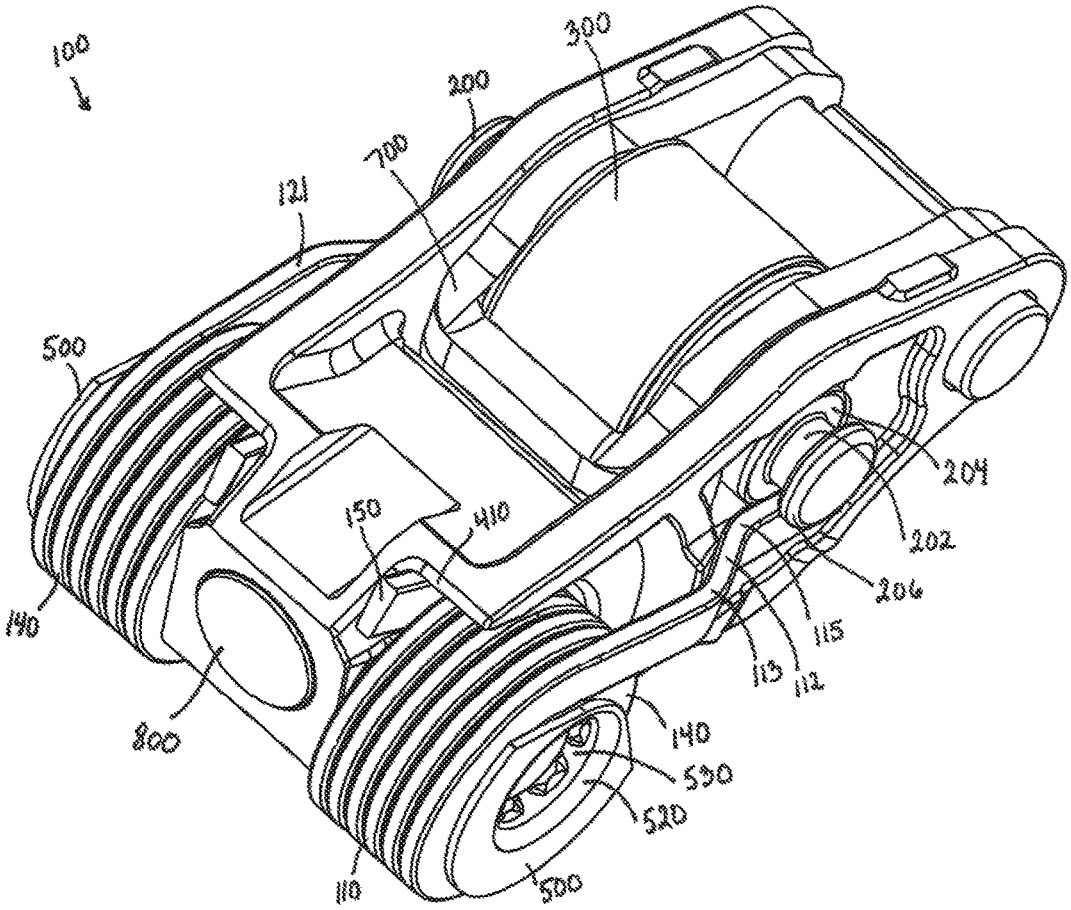
FIG. 4 is a perspective view of a rocker arm assembly.

In use, as shown in FIG. 4, the rocker arm assemblies 100, 101, 103 can further comprise a pivoting inner arm 700. A latching finger assembly 800 actuates within the rocker arm body 400. The latching finger assembly 800 is configured to interface with actuation, such as hydraulics, to extend out of the rocker arm body 400 to lock the rocker arm body 400 to the pivoting inner arm 700. Locking and unlocking the inner arm 700 to the rocker arm body 400 impacts the lifting and lowering action applied to an affiliated engine valve. The rocker arm body 400 can further comprise a valve stem pad 900 for actuating a valve stem. Coupling fingers 910 can couple the valve stem near the valve stem pad 900. Each end of the bearing axle 320 can be affiliated with a spring 110, 120, or 130, and so a rocker arm assembly 100, 101, or 103 can comprise a pair of springs 110, 120, or 130.

Other implementations will be apparent to those skilled in the art from consideration of the specification and practice of the disclosure.

What is claimed is:

1. A retainer, comprising:

an inner tubular portion comprising an inner circular edge having a radius R3; and an annular retaining surface connected to the inner tubular portion, the annular retaining surface comprising an area bounded by an outer edge and the inner circular edge, the outer edge being bounded by:

an arc AD comprising a first radius R1;

a sector CB comprising a second radius R2, where R1>R2;

a first chord DC connecting the arc AD to the sector CB; and a second chord BA connecting the arc AD to the sector CB.

2. The retainer of claim 1, wherein the inner tubular portion is corrugated.

3. A rocker arm assembly, comprising:

a rocker arm body configured to actuate a valve in a valve train, the rocker arm body comprising a ledge, a mounting body, and an extension;

a spring comprising:

a coil wrapped around the mounting body;

a first arm extending from the coil and abutting the extension; and a second arm extending from the coil and abutting the ledge, wherein the spring is tensioned between the extension and the ledge;

a retainer comprising:

an inner tubular portion fitted to the mounting body, the inner tubular portion comprising an inner circular edge having a radius R3; and an annular retaining surface connected to the inner tubular portion, the annular retaining surface comprising an area bounded by an outer edge and the inner circular edge, the outer edge being bounded by:

an arc AD comprising a first radius R1;

a sector CB comprising a second radius R2, where R1>R2;

a first chord DC connecting the arc AD to the sector CB; and a second chord BA connecting the arc AD to the sector CB, wherein the retaining surface abuts the coil to retain the coil against the rocker arm body, but wherein the retaining surface does not abut the first arm.

4. The rocker arm assembly of claim 3, wherein the first arm extends in a straight line from the coil to the extension.

5. The rocker arm assembly of claim 3, wherein the first arm comprises a single angle bend between the coil and the extension.

6. The rocker arm assembly of claim 3, wherein the first arm comprises a first angle bend and a second angle bend between the coil and the extension.

7. The rocker arm assembly of claim 3, further comprising a bearing on a bearing axle for contacting a cam.

8. The rocker arm assembly of claim 7, wherein the bearing axle is integrally formed with the extension.

9. The rocker arm assembly of claim 7, further comprising a pivoting inner arm.

10. The rocker arm assembly of claim 9, further comprising a latching finger assembly configured to lock the rocker arm body to the pivoting inner arm.

11. The rocker arm assembly of claim 7, wherein the extension is coupled to the bearing axle to move with the bearing axle.

12. The rocker arm assembly of claim 11, wherein the extension passes through a slot in the rocker arm body, wherein the spring biases the extension against one end of the slot, and wherein an opposing force on the bearing selectively moves the extension towards an opposite end of the slot.

13. The rocker arm assembly of claim 12, wherein the opposing force transfers to the spring, and the retainer resists the forces transferred to the spring.

14. The rocker arm assembly of claim 3, further comprising a valve stem pad for actuating a valve stem.

15. The rocker arm assembly of claim 14, further comprising coupling fingers for coupling the valve stem near the valve stem pad.

16. The rocker arm assembly of claim 3, wherein the mounting body is corrugated.

17. The rocker arm assembly of claim 3, wherein the inner tubular portion is corrugated.

18. The rocker arm assembly of claim 3, wherein the inner tubular portion is press-fit to the mounting body.

19. The rocker arm assembly of claim 3, wherein the mounting body is corrugated, and wherein the inner tubular portion is corrugated, and wherein the corrugations on the mounting body align to lock against the corrugations on the inner tubular portion.

* * * * *